US006115877A

United States Patent [19]

Morad et al.

[11] Patent Number: 6,115,877

[45] Date of Patent: Sep. 12, 2000

[54] MOP HOLDING APPARATUS FOR HOLDING A FREE END OF A MOP FROM TURNING WHEN THE MOP IS BEING WRUNG

[75] Inventors: Fred I. Morad, Toluca Lake; James G. Horian, Newport Beach, both of Calif.

[73] Assignee: Worldwide Integrated Resources, Inc., Commerce, Calif.

[21] Appl. No.: 09/287,794

[22] Filed: Apr. 7, 1999

[51] Int. Cl.[7] ..... A47L 13/146

[52] U.S. Cl. ..... 15/261; 15/260; 15/264

[58] Field of Search ..... 15/260, 261, 262, 15/263, 264

[56] References Cited

U.S. PATENT DOCUMENTS

| | | |
|---|---|---|
| 336,956 | 3/1886 | Smith . |
| 436,428 | 9/1890 | Mussey . |
| 447,732 | 3/1891 | Jarboe . |
| 480,303 | 9/1892 | Warner . |
| 488,984 | 1/1893 | Cathan . |
| 493,340 | 3/1893 | Prescott . |
| 504,077 | 9/1893 | Burnham . |
| 509,070 | 11/1893 | Burnham . |
| 526,449 | 9/1894 | Keller . |
| 533,122 | 1/1895 | Gebhardt . |
| 538,598 | 4/1895 | Rockwell . |
| 541,591 | 6/1895 | Burnham . |
| 544,641 | 8/1895 | Merten . |
| 549,104 | 11/1895 | Burnham . |
| 560,189 | 5/1896 | Burnham . |
| 562,349 | 6/1896 | Beech . |
| 575,510 | 1/1897 | Ramey . |
| 577,968 | 3/1897 | Struble et al. . |
| 580,249 | 4/1897 | Burnham . |
| 582,975 | 5/1897 | Best et al. . |
| 618,515 | 1/1899 | Miller . |
| 619,664 | 2/1899 | Burnham . |
| 621,481 | 3/1899 | Galen . |
| 694,517 | 3/1902 | Allison . |
| 699,073 | 4/1902 | Burnham . |
| 774,875 | 11/1904 | Halstead et al. . |
| 824,286 | 6/1906 | Cook . |
| 900,430 | 10/1908 | Schaefle . |
| 903,524 | 11/1908 | Weil . |
| 909,442 | 1/1909 | Moffat . |
| 960,371 | 6/1910 | Monahan . |
| 967,497 | 8/1910 | Charpentier . |
| 1,004,958 | 10/1911 | Allen . |
| 1,024,738 | 4/1912 | Morin . |
| 1,056,916 | 3/1913 | Lawlor . |
| 1,060,821 | 5/1913 | Cronwell . |
| 1,064,802 | 6/1913 | Wilde . |
| 1,085,346 | 1/1914 | Lawlor . |

(List continued on next page.)

*Primary Examiner*—Terrence R. Till
*Attorney, Agent, or Firm*—Thomas I. Rozsa; Tony D. Chen; Jerry Fong

[57] ABSTRACT

A mop holding apparatus requires the use of only one foot to operate the apparatus, and which is designed that a holding mechanism can be applied to hold loose ends of a mop head of a mop from turning when the mop is being wrung. The holding apparatus includes a bucket, a holding mechanism, and an operating mechanism. The holding mechanism is mounted on the top of the bucket. It includes a bottom plate, a first extending arm formed with the bottom plate and extending upwardly therefrom, and a second movable extending arm connected with the first extending arm at converging ends. The bottom plate has perforations therethrough for allowing fluid to drain to the bottom of the bucket from the mop head when the mop is wrung. The operating mechanism includes a foot pedal mounted on the bucket and a strap operatively interconnecting the foot pedal to the second movable extending arm of the holding mechanism, where the foot pedal is operative on depression of the foot pedal to produce a closing movement on the second movable extending arm to move toward the first extending arm for holding the loose ends of the mop head, and thereby also allows the fluid from the mop head to drain through the perforations of the bottom plate of the holding mechanism and into the bucket.

24 Claims, 5 Drawing Sheets

U.S. PATENT DOCUMENTS

| | | | |
|---|---|---|---|
| 1,148,490 | 7/1915 | Ellis . | |
| 1,179,694 | 4/1916 | Bushnell . | |
| 1,184,543 | 5/1916 | Lepak . | |
| 1,234,721 | 7/1917 | Boggess . | |
| 1,378,879 | 5/1921 | Lawlor . | |
| 1,428,893 | 9/1922 | Lawlor . | |
| 1,491,647 | 4/1924 | Washer . | |
| 1,492,240 | 4/1924 | Burke . | |
| 1,500,058 | 7/1924 | Courtemanche . | |
| 1,522,654 | 1/1925 | Solove . | |
| 1,533,021 | 4/1925 | Mather . | |
| 1,541,886 | 6/1925 | Wolter . | |
| 1,613,267 | 1/1927 | Eiffe . | |
| 1,808,643 | 6/1931 | Dwork . | |
| 1,862,891 | 6/1932 | Fritsch . | |
| 1,955,445 | 4/1934 | Wenger . | |
| 1,965,342 | 7/1934 | Hufford . | |
| 2,023,134 | 12/1935 | Gringer . | |
| 2,159,577 | 5/1939 | Walters . | |
| 2,246,248 | 6/1941 | Grosser . | |
| 2,252,436 | 8/1941 | MacGraham . | |
| 2,277,676 | 3/1942 | Blanchard . | |
| 2,328,797 | 9/1943 | Fritsch et al. . | |
| 2,535,244 | 12/1950 | Van Voorhis et al. . | |
| 2,577,496 | 12/1951 | Wolfer . | |
| 3,280,418 | 10/1966 | Schonberger | 15/261 |
| 3,699,606 | 10/1972 | Ribas . | |
| 3,795,939 | 3/1974 | Seufert . | |
| 4,161,799 | 7/1979 | Sorrells | 15/260 |
| 4,716,619 | 1/1988 | Young . | |
| 4,798,307 | 1/1989 | Evrard | 15/264 |
| 5,070,574 | 12/1991 | Delmerico et al. | 15/261 |
| 5,974,621 | 11/1999 | Wilen | 15/261 |

MOP HOLDING APPARATUS FOR HOLDING A FREE END OF A MOP FROM TURNING WHEN THE MOP IS BEING WRUNG

BACKGROUND OF THE INVENTION

1. Field of the Invention

The present invention generally relates to the field of utility containers. More particularly, the present invention relates to the field of utility containers for holding various liquid agents, such as scrubbing and rinsing solutions and the like, together with a mechanism for holding loose ends of a mop head from turning when the mop is being wrung.

2. Description of the Prior Art

In its most basic form, a mop was wrung out by twisting with the hands of a user, but this proved to be inefficient as well as harmful to the user's hands. Various types of mechanical wringers have been designed over the years for performing this function. One such prior art device includes a stationary horizontal roller and a second horizontal roller whose axis could be moved so that the two rollers would be brought together against the mop, and the mop would be withdrawn upwardly to thereby squeeze the water out of the mop.

The following four (4) prior art patents are found to be pertinent to the field of the present invention:

1. U.S. Pat. No. 562,349 issued to Beech on Jun. 16, 1896 for "Combined Mop And Wringer Pail" (hereafter the "Beech Patent");
2. U.S. Pat. No. 3,699,606 issued to Ribas on Oct. 24, 1972 for "Mop Wringer" (hereafter the "Ribas Patent");
3. U.S. Pat. No. 3,795,939 issued to Seufert on Mar. 12, 1974 for "Utility Container Assembly For Use With Sponge Applicator" (hereafter the "Seufert Patent"); and
4. U.S. Pat. No. 4,716,619 issued to Young on Jan. 5, 1988 for "Mopping Unit" (hereafter the "Young Patent").

The Beech Patent discloses a combined mop and wringer pail. It includes parallel slotted guides, in which are arranged rollers. The rollers are adapted to rotate freely therein, and are normally held apart by springs. Journals of one of the rollers are connected with a pedal by chains passed over pulleys in loops in the ends of the guides. The chains are held in place by the loops. The pedal is fitted to the pail, and is normally elevated by the stress of the springs, so that when the pedal is depressed the roller with which it is connected is caused to approach the other roller, so as to apply squeezing action upon a mop between the two rollers.

The Ribas Patent discloses a mop wringer. It includes a bucket, a funnel-shaped member with perforations at the lower end portion of the walls, a piston member cooperating with the perforated walls of the funnel for wringing a mop, and a foot-operated lever for moving the piston which in turn moves a squeeze plate for squeezing the mop.

The Seufert Patent discloses a utility container and wringer assembly for use with a sponge applicator. It includes a wheel mounted frame supporting a plurality of individual containers for liquids. The wringer assembly is positioned over one of the containers for squeezing liquid from the sponge mop type applicator.

The Young Patent discloses a mopping unit. It comprises a bucket, a wringer with two squeeze rollers mounted at the top of the bucket, and an operating mechanism to produce relative closing movement of the rollers. The operating mechanism comprises a foot pedal mounted at a lower level on the bucket and a toggle operating linkage operable by depression of the pedal to produce the relative closing movement of the squeeze rollers, the operating mechanism going over center to lock the rollers at a predetermined spacing in the wringing position, while the mop is pulled through the wringer assembly.

It is desirable to provide a mop holding apparatus for holding loose ends of a mop head from turning when the mop is being wrung. It is also desirable to provide a mop holding apparatus for holding various liquid agents, such as scrubbing and rinsing solutions and the like.

SUMMARY OF THE INVENTION

The present invention is a mop holding apparatus which requires the use of only one foot to operate the holding apparatus, and which is designed so that a wringer holding mechanism can be applied to hold loose ends of a mop head from turning when the mop is being wrung.

The holding apparatus includes a bucket, a wringer holding mechanism, and a wringer operating mechanism. The bucket is used for holding various liquid agents therein and having a recess molded in one of the four vertical walls of the bucket at the bottom edge thereof. The holding mechanism is mounted on the top of the bucket. It includes a bottom plate, a first extending arm formed with the bottom plate and extending upwardly therefrom, and a second movable extending arm connected with the first extending arm at adjacent converging ends. The bottom plate has perforations therethrough for allowing fluid to drain to the bottom of the bucket from the mop head when the mop is being wrung.

The operating mechanism includes a foot pedal disposed within the recess of the bucket and means for operatively interconnecting the foot pedal to the second movable extending arm of the holding mechanism, where the foot pedal is operative on depression of the foot pedal to produce a closing movement on the second movable extending arm to move toward the first extending arm for holding the loose ends of the mop head. The holding mechanism also allows the fluid from the mop head to drain through the perforations of the bottom plate and into the bucket. When the foot pedal is released, the second movable extending arm springs back to its "open" condition and releases the loose ends of the mop head.

It is an object of the present invention to provide a mop holding apparatus which only requires the use of one foot to operate the mop holding apparatus, so that the holding apparatus can be applied to hold loose ends of a mop head of a self-wringing mop, deck mop or any other mop from turning when the mop is being wrung by a user.

It is also an object of the present invention to provide a mop holding apparatus which not only holds the loose ends of the mop head from turning but also retains the fluid from the mop head when the mop is wrung.

It is an additional object of the present invention to provide a mop holding apparatus which is simple and inexpensive to manufacture and easy to use.

It is a further object of the present invention to provide a mop holding apparatus which is efficient for a person to use without putting any force on the person's back to wring the mop by bending.

It is still a further object of the present invention to provide a mop holding apparatus which eliminates a person from using enormous pressure to push down the mop for wringing.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
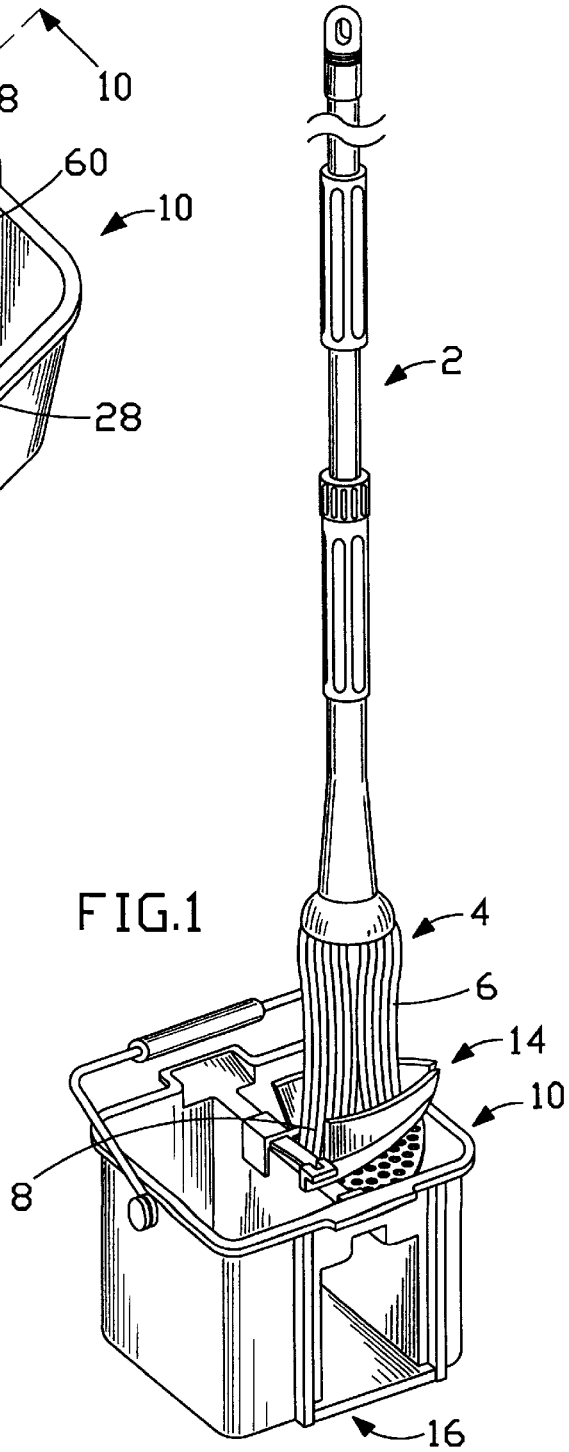
FIG. 1 is an illustrative view of the present invention mop holding apparatus in use.

Referring to FIG. 1, there is illustrated at 10 the present invention mop holding apparatus used in conjunction with a self-wringing mop, deck mop or any other suitable mop 2 which has a mop head 4 made from a plurality of yarns 6. The mop head 4 has loose ends 8 held by a wringer holding mechanism 12 provided by the holding apparatus 10, as shown, to prevent the loose ends 8 from turning when the mop 2 is being wrung.

Referring to FIGS. 1, 2, 3, and 4, the mop holding apparatus 10 comprises a molded plastic bucket, container or any fluid retaining means 12 for holding fluid therein, a wringer holding mechanism 14, and a wringer operating mechanism 16.

Figure 2:
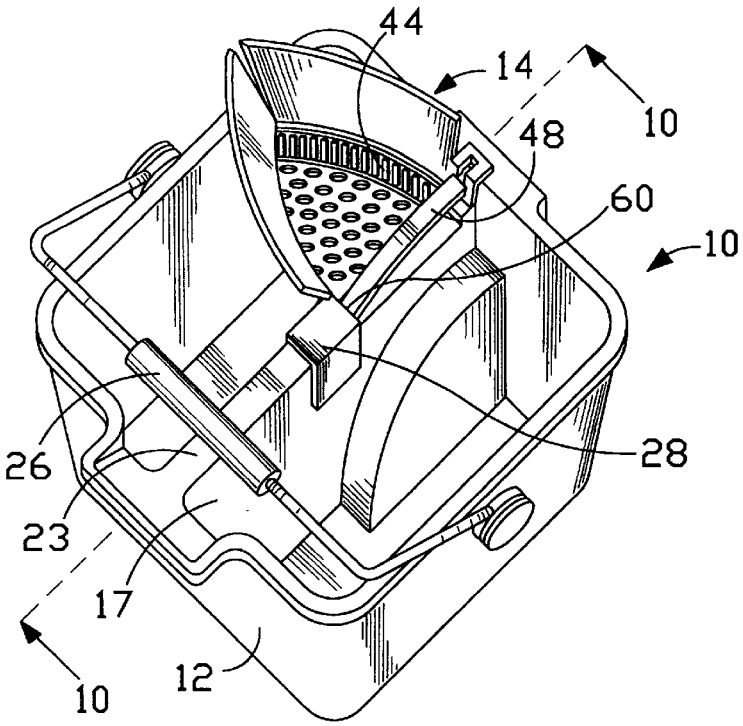
FIG. 2 is a perspective view of the present invention mop holding apparatus.
Figure 3:
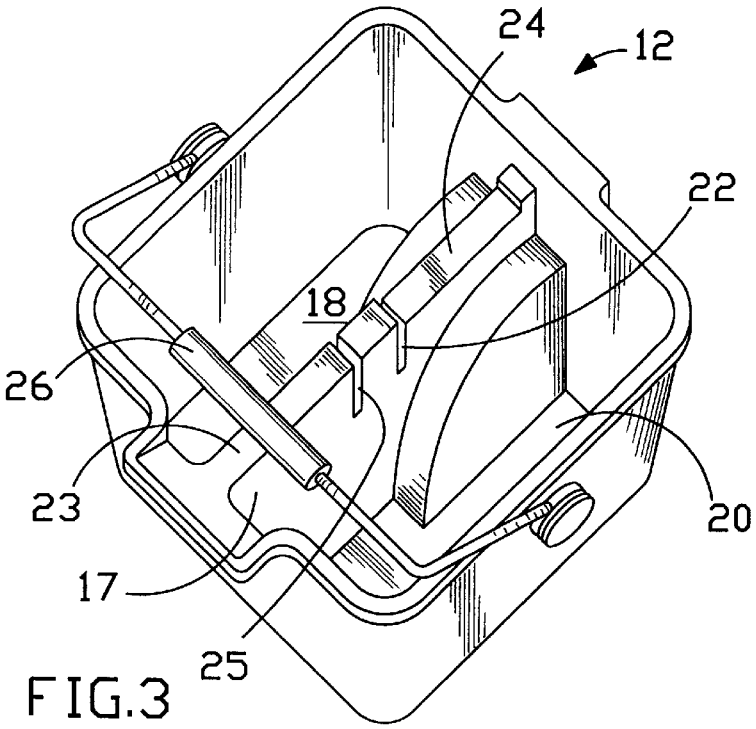
FIG. 3 is a perspective view of a bucket of the present invention mop holding apparatus.

Referring to FIGS. 2 and 3, there is shown the bucket 12 which has a generally square shaped configuration with a bottom and four exterior vertical walls extending upwardly from the bottom. An interior wall 17 is integrally formed with two of the four exterior vertical walls and the bottom, and centrally located within the bucket 12 to form two separate fluid chambers 18 and 20 as shown. One of the chambers may be used for holding clean water while the other chamber may be used for holding dirty water. The interior wall 17 has two spaced apart vertical retaining slots 22 and 25 which extend partially down into the bucket 12 and an upper ledge 23 with a depressed portion 24. The bucket 12 has a handle 26 by which it can be carried by a user and is attached to the other two of the four exterior vertical walls.

Figure 6:
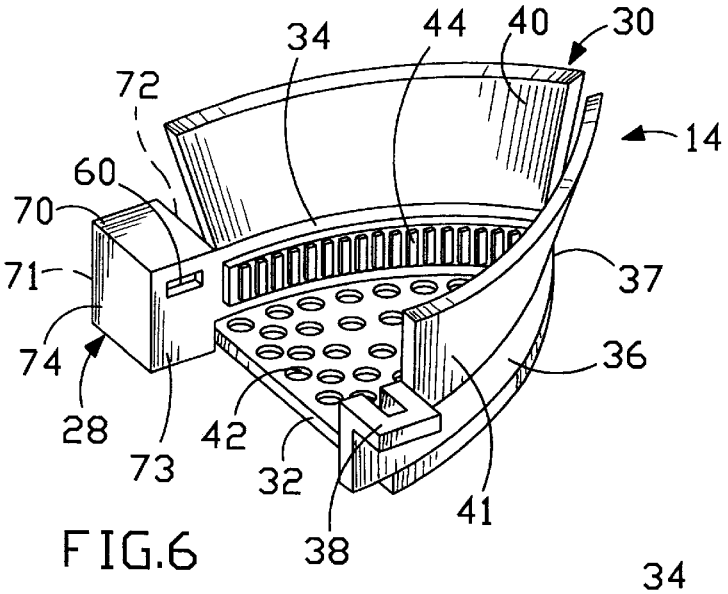
FIG. 6 is a perspective view of a wringer holding mechanism of the present invention mop holding apparatus, showing the holding mechanism in an open or released condition.
Figure 7:
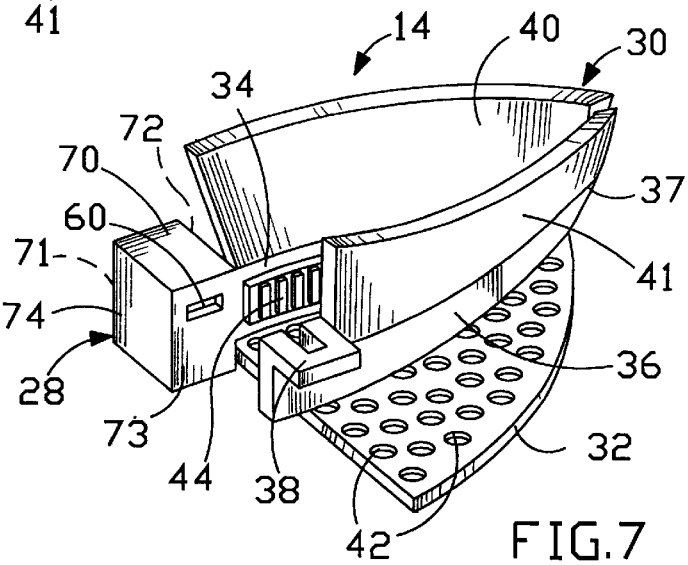
FIG. 7 is a perspective view of the wringer holding mechanism of the present invention mop holding apparatus, showing the holding mechanism in a closed or holding condition.

Referring to FIGS. 1, 2, 4, 6, and 7, the holding mechanism 14 is mounted on top of the bucket 12 and is movable by the operating mechanism 16 between the free "open" position shown in FIG. 6, and the "closed" operative holding position shown in FIG. 7. The holding mechanism 14 comprises a clamping or holding member 30 and a solid V-shaped bottom plate 32. The clamping member 30 has an inwardly curved stationary sidewall or extending arm 34 and an inwardly curved movable elastic sidewall or extending arm 36, where both arms 34 and 36 are integrally connected to each other at converging adjacent ends 37. The extending arm 34 is also integrally formed to the bottom plate 32 in the lengthwise direction while the extending arm 36 is not attached in its lengthwise portion (see FIG. 8). The extending arms 34 and 36 are provided with serrated interior surfaces 44 for further providing added gripping means for holding the loose ends 8 of the mop head 4.

Referring to FIGS. 1, 6, 7, and 9, there are shown a support retaining bracket 28 and an attachment bracket 38 which are provided with the clamping member 30 and are integrally formed with the free ends of the extending arm 34 and the movable arm 36 respectively. The support retaining bracket 28 has a top wall 70 and four sidewalls 71, 72, 73, and 74 extending downwardly from the top wall. Sidewalls 71 and 73 have a slot aperture 60 therethrough (only one is shown in FIGS. 6 and 7). The attachment bracket 38 has an aperture therethrough 39. Two upper siphon lips 40 and 41 which act like a funnel are provided with the holding mechanism 14 and are integrally formed on top of the extending arms 34 and 36 respectively for further receiving the loose ends 8 of the mop head 4 and catching the fluid from the mop head 4 when the mop 2 is being wrung. The siphon lips 40 and 41 also prevent splashing of fluid and maintain the fluid from the mop 2 to be retained within the bucket 12. The siphon lips 40 and 41 are not attached to each other so that they provide a yield when the clamping member 30 is in its closed operative holding position.

The bottom plate 30 contains a plurality of perforations 42 for draining the fluid wrung from the mop 2 back into the bucket 12. Determination of the size of the perforations 42 as well as the spacing is well known in the art and need not be described further. The number and size of the perforations 42 should be sufficient to provide rapid drainage from the holding mechanism 14 into the bucket 12 during a wringing operation on the mop 2, so that the mop 2 does not re-absorb the liquid upon release of the pressure.

Figure 8:
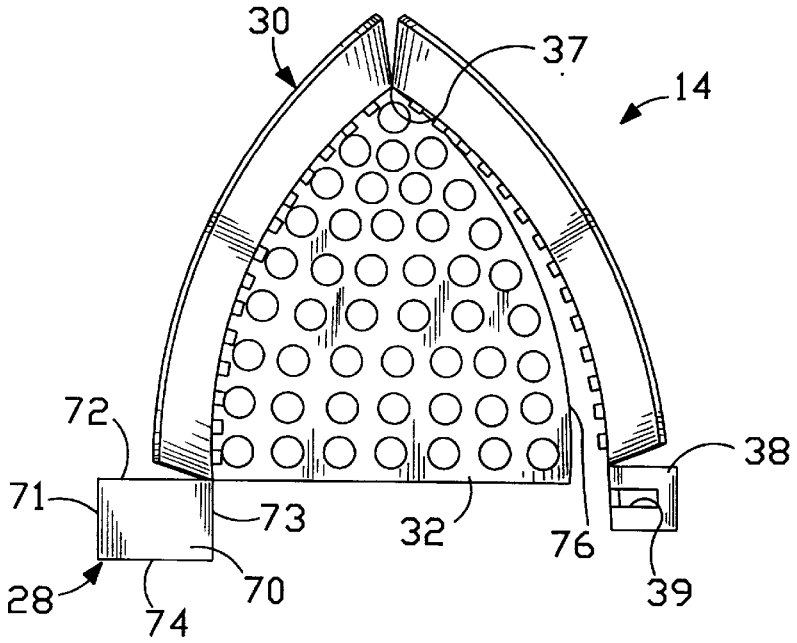
FIG. 8 is a top plan view of the wringer holding mechanism of the present invention mop holding apparatus.
Figure 9:
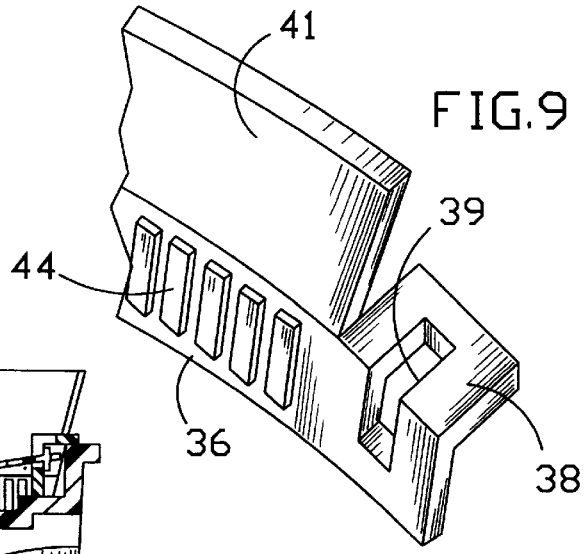
FIG. 9 is a partial perspective of one of the two extending arms of the wringer holding mechanism.
Figure 10:
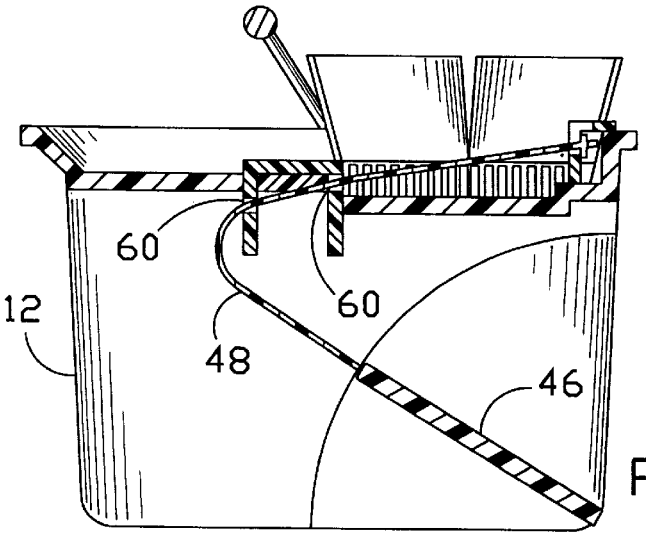
FIG. 10 is a cross-sectional view taken along line 10—10 of the FIG. 2.

Referring to FIG. 8, one of the unique features of the wringer holding mechanism 14 is how it is made. The wringer holding mechanism 14 can be molded in one piece or one step process, where a gap or space 76 is provided between the bottom plate 32 and the movable extending arm 36. What the gap 76 is solving is that the bottom plate 32 and the extending arm 36 do not need to be separated or cut by the manufacturer, thereby saving an extra step in the manufacturing process of the wringer holding mechanism 14.

Referring again to FIGS. 1, 2 and 3, the holding mechanism 14 is installed by respectively inserting the two sidewalls 71 and 73 of the support retaining bracket 28 into the two vertical slots 25 and 22 on the interior wall 17 such that the holding mechanism 14 is laterally positioned over the first fluid chamber 18 as shown in FIG. 2.

Figure 4:
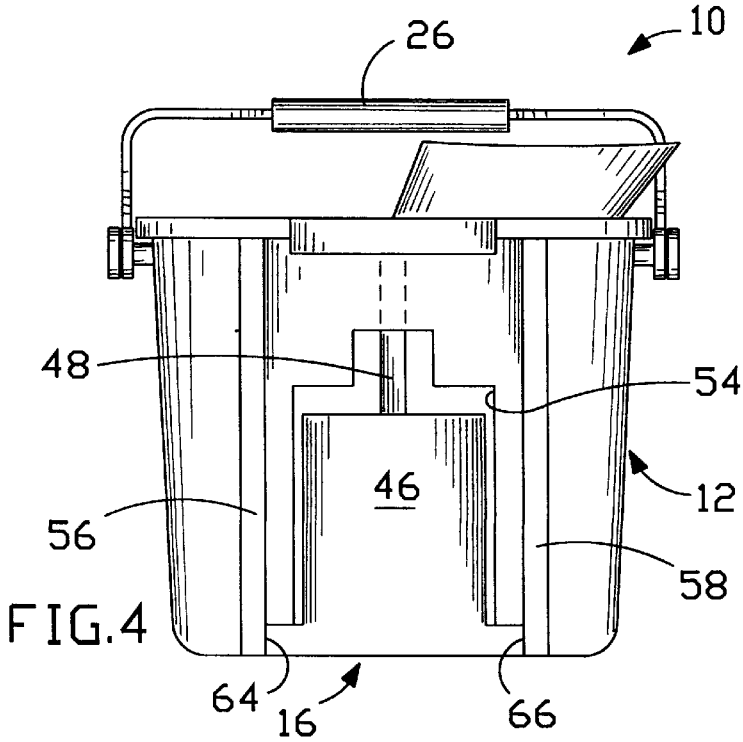
FIG. 4 is an elevational view of a wringer operating mechanism of the present invention mop holding apparatus.
Figure 5:
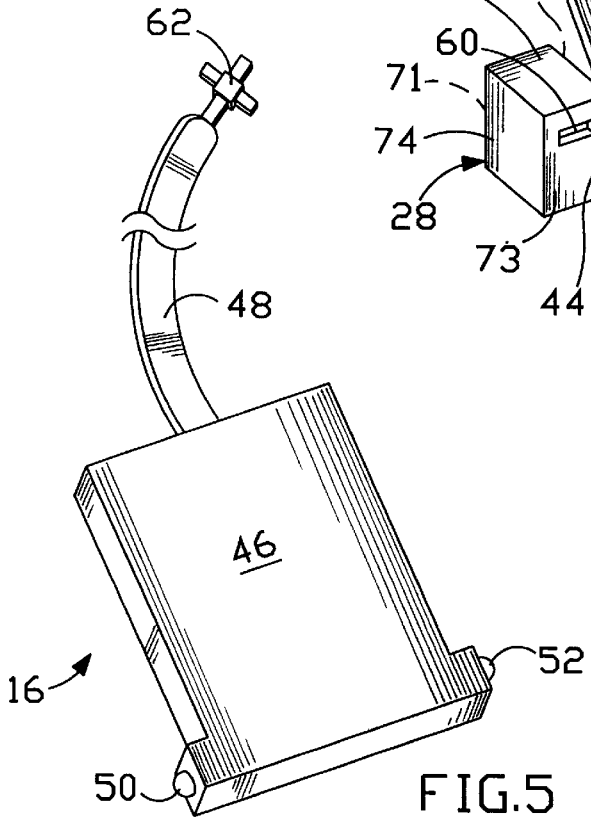
FIG. 5 is a perspective view of a foot pedal of the operating mechanism of the present invention mop holding apparatus.

Referring to FIGS. 4 and 5, there is shown the operating mechanism 16 which comprises a foot-operated pedal 46 and interconnecting means 48, such as a flexible injected plastic strap, cable, rope or any other suitable means, integrally connected to the top end of the pedal 46. The foot-operated pedal 46 has two opposite bosses 50 and 52 located on the lengthwise edges of the pedal 46. The foot-operated pedal 46 is disposed at the bottom of a central recess 54 molded into one of the vertical walls of the bucket 12. This pedal 46 is mounted between two opposite protruding columns 56 and 58, where the bosses 50 and 52 are secured within two opposite recesses 64 and 66, respectively provided on the columns 56 and 58. The flexible strap 48 has a latching cross shaped member 62 which is integrally formed thereto.

Referring again to FIGS. 1, 2, 3, 4, and 10, the flexible strap 48 is inserted underneath the bucket 12 and through apertures 60 provided on the sidewalls 71 and 73 of the support retaining bracket 28, where the strap 48 is also inserted and installed into the aperture 39 on the attachment bracket 38 and secured thereto by the latching cross member 62. It will be appreciated that any conventional means known to one skilled in the art is suitable Thus foot pressure is applied to the pedal 46 such that the flexible strap 48 pulls the movable elastic extending arm 36 toward the stationary arm 34 to hold the loose ends 8 of the mop head 4 thereto, where the loose ends 8 of the mop head 4 are prevented from turning when the mop 2 is being wrung. The mop 2 is then wrung which allows the fluid form the mop head to drain through the perforations 42 of the bottom plate 32 of the holding mechanism 14 and into the bucket 12. When the foot pedal 46 is released, the movable elastic extending arm 36 springs back to its open position as shown in FIG. 6 and releases the loose ends of the mop head.

Figure 11:
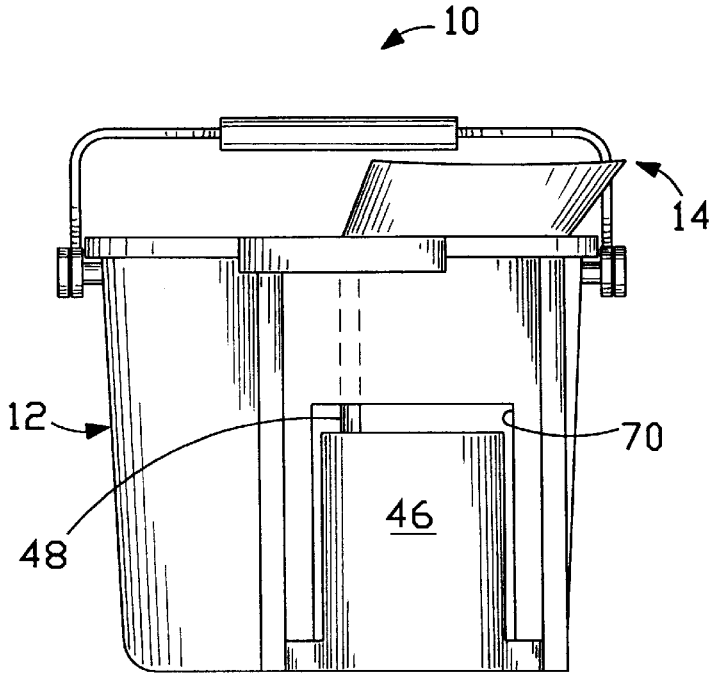
FIG. 11 is an elevational view of an alternative arrangement of the wringer operating mechanism of the present invention mop holding apparatus, showing the foot pedal mounted adjacent to one side of the bucket.

It will be appreciated that the foot pedal 46 is preferably mounted in the central recess 54 as shown in FIG. 4. However, it is also within the spirit and scope of the present invention mop holding apparatus 10 to mount the foot pedal 46 in a recess 70 located at one side of the bucket 12 as shown in FIG. 11. In this arrangement, the foot pedal 46 is directly underneath the wringer holding mechanism 14 to provide optimum holding of the bucket 12 when the holding mechanism 14 is used and the flexible strap 48 is integrally formed on one side of the foot pedal 46.

Figure 12:
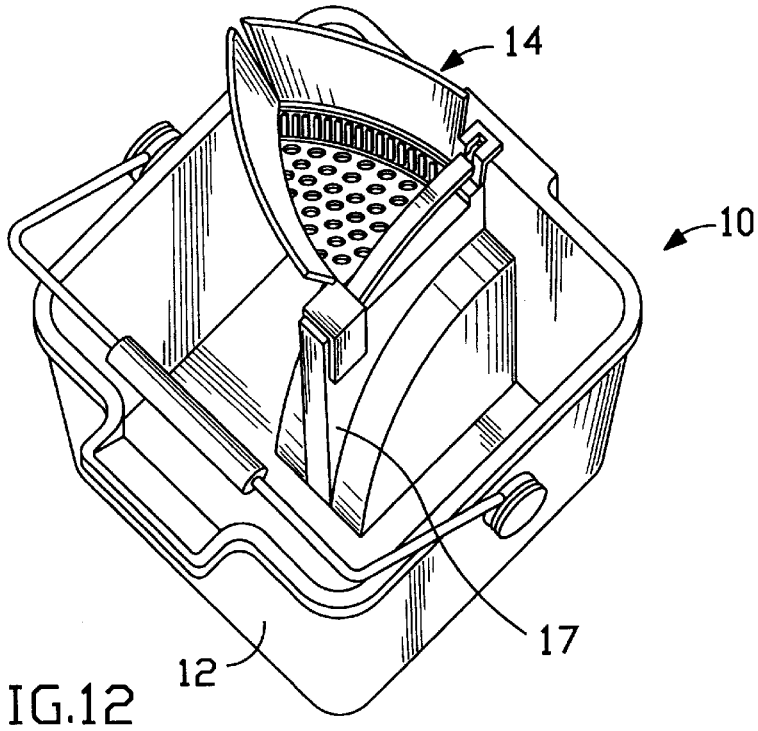
FIG. 12 is a perspective view of an alternative arrangement of the bucket of the present invention mop holding apparatus.

Referring to FIG. 12, there is shown an alternative embodiment of the present invention mop holding apparatus 10 which is very similar to the embodiment just discussed and the only difference is the nature and configuration of the interior wall 17 of the bucket 12. In this embodiment, the interior wall 17 is integrally formed with only one exterior vertical wall of the bucket 12 and extends to a mid-section of the bucket 12, and thereby allows the two fluid chambers 18 and 20 to form a single fluid chamber. All of the components in this embodiment are the same to that in the preceding embodiment, and the description thereof will not be repeated.

The present invention conforms to conventional forms of manufacture or any other conventional way known to one skilled in the art. The manufacturing process which could accommodate the construction of the mop holding apparatus may be injection, thermoform, etc. or other molding process. By way of example, the mop holding apparatus can be made of a plastic molding, for example polypropylene or high density polyethylene.

Defined in detail, the present invention is a holding apparatus used in conjunction with a mop having a mop head made of a plurality of yarns, the mop head having loose ends held by the holding apparatus which prevent them from turning when the mop is being wrung, the apparatus comprising: (a) a container for holding fluid therein and having a central recess; (b) a holding mechanism mounted on the top of the container and having a bottom plate, a first sidewall integrally formed with the bottom plate and extending upwardly therefrom, and a movable elastic sidewall integrally connected with the first sidewall at converging ends and located adjacent to the bottom plate, the bottom plate having perforations therethrough for allowing fluid to drain to the bottom of the container from the mop head when the mop is being wrung; and (c) an operating mechanism having a foot pedal disposed within the central recess of the container and a flexible strap operatively connected to the movable elastic sidewall and the foot pedal, where the foot pedal is operative on depression of the foot pedal to produce a horizontal closing movement of the movable elastic sidewall to move toward the first sidewall for holding the loose ends of the mop head; (d) whereby the movable elastic sidewall is actuated by the foot pedal of the operating mechanism to move toward the first sidewall to hold the loose ends of the mop head therein from turning when the mop is being wrung, and thereby also allows the fluid from the mop head to drain through the perforations of the bottom plate of the holding mechanism and into the container, and when the foot pedal is released, the movable elastic sidewall springs back to its original position and releases the loose ends of the mop head.

Defined broadly, the present invention is an apparatus used in conjunction with a mop having a mop head made of a plurality of yarns, the mop head having loose ends held by the holding apparatus which prevent them from turning when the mop is being wrung, the apparatus comprising: (a) a container for holding fluid therein and having a recess; (b) a holding mechanism mounted on the top of the container and having a bottom plate, a first arm formed with the bottom plate and extending upwardly therefrom, and a second arm connected with the first arm at converging ends and located adjacent to the bottom plate, the bottom plate having perforations therethrough for allowing fluid to drain to the bottom of the container from the mop head when the mop is being wrung; (c) a foot pedal disposed within the recess of the container; and means for operatively interconnecting the foot pedal to the second arm of the holding mechanism, where the foot pedal is operative on depression of the foot pedal to produce a closing movement of the second arm to move toward the first arm for holding the loose ends of the mop head; (d) whereby the second arm is actuated by the foot pedal to move toward the first arm to hold the loose ends of the mop head therein from turning when the mop is being wrung, and thereby also allows the fluid from the mop head to drain through the perforations of the bottom plate of the holding mechanism and into the container, and when the foot pedal is released, the second arm springs back to its original position and releases the loose ends of the mop head.

Defined more broadly, the present invention is an apparatus used in conjunction with a mop having a mop head made of a plurality of yarns, the mop head having loose ends held by the apparatus which prevent them from turning when the mop is being wrung, the apparatus comprising: (a) fluid retaining means for holding fluid therein; (b) holding means mounted on the fluid retaining means; (c) actuating means mounted on the fluid retaining means; and (d) means for operatively interconnecting the actuating means to the holding means to produce a closing movement of the holding means for holding the loose ends of the mop head; (e) whereby the holding means is actuated by the actuating means to hold the loose ends of the mop head therein from turning when the mop is being wrung, and thereby also allows the fluid from the mop head to drain into the fluid retaining means, and when the actuating means is deactivated, the holding means releases the loose ends of the mop head.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A holding apparatus used in conjunction with a mop having a mop head made of a plurality of yarns, the mop head having loose ends held by the holding apparatus which prevent them from turning when the mop is being wrung, the apparatus comprising:

a. a container for holding fluid therein and having a central recess;

b. a holding mechanism mounted on the top of said container and having a bottom plate, a first sidewall integrally formed with the bottom plate and extending upwardly therefrom, and a movable elastic sidewall integrally connected with the first sidewall at converging ends and located adjacent to the bottom plate, the bottom plate having perforations therethrough for allowing fluid to drain to the bottom of said container from said mop head when said mop is being wrung; and c. an operating mechanism having a foot pedal disposed within said central recess of said container and a flexible strap operatively connected to said movable elastic sidewall and the foot pedal, where the foot pedal is operative on depression of the foot pedal to produce a horizontal closing movement of said movable elastic sidewall to move toward said first sidewall for holding said loose ends of said mop head;

d. whereby said movable elastic sidewall is actuated by said foot pedal of said operating mechanism to move toward said first sidewall to hold said loose ends of said mop head therein from turning when said mop is being wrung, and thereby also allows the fluid from said mop head to drain through said perforations of said bottom plate of said holding mechanism and into said container, and when said foot pedal is released, said movable elastic sidewall springs back to its original position and releases said loose ends of said mop head.

2. The holding apparatus in accordance with claim 1, wherein said apparatus is made of molded plastic.

3. The holding apparatus in accordance with claim 1, wherein said container further comprises a handle for carrying said container.

4. The holding apparatus in accordance with claim 1, wherein said sidewalls of said holding mechanism further comprise serrated interior surfaces.

5. The holding apparatus in accordance with claim 1, wherein said holding mechanism further comprises a funnel integrally formed on top of said sidewalls for further receiving said loose ends of said mop head and catching the drain fluid from said mop head when said mop is being wrung.

6. An apparatus used in conjunction with a mop having a mop head made of a plurality of yarns, the mop head having loose ends held by the holding apparatus which prevent them from turning when the mop is being wrung, the apparatus comprising:

a. a container for holding fluid therein and having a recess;

b. a holding mechanism mounted on the top of said container and having a bottom plate, a first arm formed with the bottom plate and extending upwardly therefrom, and a second arm connected with the first arm at converging ends and located adjacent to the bottom plate, the bottom plate having perforations therethrough for allowing fluid to drain to the bottom of said container from said mop head when said mop is being wrung;

c. a foot pedal disposed within said recess of said container; and d. means for operatively interconnecting said foot pedal to said second arm of said holding mechanism, where said foot pedal is operative on depression of said foot pedal to produce a closing movement of said second arm to move toward said first arm for holding said loose ends of said mop head;

e. whereby said second arm is actuated by said foot pedal to move toward said first arm to hold said loose ends of said mop head therein from turning when said mop is being wrung, and thereby also allows the fluid from said mop head to drain through said perforations of said bottom plate of said holding mechanism and into said container, and when said foot pedal is released, said second arm springs back to its original position and releases said loose ends of said mop head.

7. The apparatus in accordance with claim 6, wherein said apparatus is made of molded plastic.

8. The apparatus in accordance with claim 6, wherein said container further comprises a handle for carrying said container.

9. The apparatus in accordance with claim 6, wherein said first and second arms of said holding mechanism further comprise serrated interior surfaces.

10. The apparatus in accordance with claim 6, wherein said holding mechanism further comprises a funnel attached on top of said first and second arms for further receiving said loose ends of said mop head and catching the drain fluid from said mop head when said mop is being wrung.

11. The apparatus in accordance with claim 6, wherein said foot pedal is centrally located within said container.

12. The apparatus in accordance with claim 6, wherein said foot pedal is positioned at one side of said container and located underneath said holding mechanism.

13. The apparatus in accordance with claim 6, wherein said interconnecting means includes a flexible strap.

14. An apparatus used in conjunction with a mop having a mop head made of a plurality of yarns, the mop head having loose ends held by the apparatus which prevent them from turning when the mop is being wrung, the apparatus comprising:

a. fluid retaining means for holding fluid therein;

b. holding means mounted on said fluid retaining means and having a fixed extending arm and a movable extending arm connected to the fixed extending arm at converging ends;

c. actuating means mounted on said fluid retaining means; and d. means for operatively interconnecting said actuating means to said movable extending arm of said holding means to produce a closing movement of said holding means for holding said loose ends of said mop head;

e. whereby said holding means is actuated by said actuating means to hold said loose ends of said mop head therein from turning when said mop is being wrung, and thereby also allows the fluid from said mop head to drain into said fluid retaining means, and when said actuating means is deactivated, said holding means releases said loose ends of said mop head.

15. The apparatus in accordance with claim 14, wherein said apparatus is made of molded plastic.

16. The apparatus in accordance with claim 14 wherein said fluid retaining means includes a bucket.

17. The apparatus in accordance with claim 16, wherein said bucket further comprises a handle for carrying said bucket.

18. The apparatus in accordance with claim 14, wherein said holding means further comprise a bottom plate formed with said fixed extending arm, the bottom plate having perforations therethrough for allowing fluid to drain to the bottom of said fluid retaining means from said mop head when said mop is being wrung.

19. The apparatus in accordance with claim 18, wherein said arms of said holding means include serrated interior surfaces.

20. The apparatus in accordance with claim 19, wherein said holding means further comprises a funnel formed on top of said arms for receiving said loose ends of said mop head and catching the drain fluid from said mop head when said mop is being wrung.

21. The apparatus in accordance with claim 14, wherein said actuating means includes a foot pedal.

22. The apparatus in accordance with claim 21, wherein said foot pedal is centrally located within said fluid retaining means.

23. The apparatus in accordance with claim 21, wherein said foot pedal is positioned at one side of said fluid retaining means and located underneath said holding means.

24. The apparatus in accordance with claim 14, wherein said interconnecting means includes a flexible strap.

* * * * *